United States Patent [19]

Skowronski

[11] Patent Number: 4,725,055

[45] Date of Patent: Feb. 16, 1988

[54] LOWER BODY STABILIZATION APPARATUS FOR A BACK TEST, REHABILITATION AND EXERCISE MACHINE

[75] Inventor: Richard E. Skowronski, West Sayville, N.Y.

[73] Assignee: Lumex, Inc., Bay Shore, N.Y.

[21] Appl. No.: 802,689

[22] Filed: Nov. 27, 1985

[51] Int. Cl.[4] ..... A63B 21/00

[52] U.S. Cl. ..... 272/134; 272/DIG. 4; 272/144; 272/143

[58] Field of Search ..... 272/134, 143, 144, 145, 272/D4, 93, 116, 117, 125; 73/379; 128/774, 782, 33; 403/109, 104

[56] References Cited

U.S. PATENT DOCUMENTS

| | | | |
|---|---|---|---|
| 2,283,475 | 5/1942 | Wagner . | |
| 3,463,146 | 8/1969 | Schwartz et al. . | |
| 4,022,463 | 5/1977 | Scott, Jr. . | |
| 4,134,703 | 1/1979 | Hinners | 403/104 |
| 4,322,071 | 3/1982 | Lambert, Jr. et al. . | |
| 4,349,193 | 9/1982 | Lambert, Jr. et al. . | |
| 4,349,195 | 9/1982 | Johnston . | |
| 4,456,245 | 6/1984 | Baldwin | 272/143 |
| 4,456,302 | 6/1984 | Knoedler | 297/464 |
| 4,462,252 | 7/1984 | Smidt | 272/DIG. 4 X |
| 4,609,190 | 9/1986 | Brentham | 272/144 X |

FOREIGN PATENT DOCUMENTS 2112653 7/1983 United Kingdom .

OTHER PUBLICATIONS

Athletic J. vol. 55, No. 4, Dec. 1974, pp. 15, 26, 28, 30, 31 and 77–80.

"Quantitative Assessment of Back Strength Using Isokinetic Testing" *Spine*, vol. 9, No. 3, 1984 (287–290).

*Primary Examiner*—Richard J. Apley
*Assistant Examiner*—H. Flaxman
*Attorney, Agent, or Firm*—Davis Hoxie Faithfull & Hapgood

[57] ABSTRACT

A lower body stabilization apparatus for a back test, rehabilitation and exercise machine designed for the isolated testing, rehabilitation and exercise of the lower back musculature of a person in rotation about a vertical axis is disclosed. The lower body stabilization apparatus has a seat on which the person sits. The seat may be raised or lowered so that a scapula pad of an upper body rotation assembly of the machine is against the scapula of the person. A seat back which bears against the lower back of the person may be moved forward or backward in order to align the natural anatomical axis below the waist of the person with the axis of rotation of the rotation assembly. A lap belt secured into a lap belt buckle holds the person against the seat back and also down against the seat. Two side cushions bear against the pelvis to prevent lateral movement of the pelvis. Two knee pads of a knee pad assembly bear against the inside of the legs between the knees and thighs. Leg straps of the knee pad assembly looped around the outside of the thighs are secured to leg strap buckels on top of the knee pad assembly above the thighs. The knee pads and the leg straps prevent pelvic rotation and thigh movement. The feet of the person are secured in foot bindings on footplates. The height of the footplates relative to the seat is adjustable.

18 Claims, 10 Drawing Figures

LOWER BODY STABILIZATION APPARATUS FOR A BACK TEST, REHABILITATION AND EXERCISE MACHINE

FIELD OF THE INVENTION

This invention relates to a lower body stabilization apparatus for a back test, rehabilitation and exercise machine designed for the isolated testing, rehabilitation and exercise of the lower back musculature in rotation about a vertical axis.

BACKGROUND OF THE INVENTION

Medical personnel, such as orthopaedic physicians and physical therapists, have long sought an effective way to measure in isolation the strength of the musculature of a patient's lower back in rotation about a vertical axis. Medical personnel have also sought a machine which could be used for the rehabilitation of the musculature of a patient's lower back after surgery, a stroke or other illness, or an accident, whereby the patient could rotate his or her lower back to its full strength capability and range of motion without danger of injury.

Also, employers who employ patient in job functions which require extensive rotational movement of the lower back have long sought a way to screen potential employees for rotational strength deficiencies or rotational range of motion limitations. By testing the rotational strength of a potential employee's lower back musculature prior to assigning the patient to the specified job function, the employer can determine whether the potential employee has the lower back musculature rotational strength and rotational range of motion needed for the job function. Such industrial screening is of value in keeping health insurance costs down by reducing the incidence of employee injuries, and is also of value by increasing work-force productivity.

In order to effectively measure in isolation the strength of the musculature a patient's lower back in rotation about a vertical axis, it is necessary to prevent muscle groups in the patient's upper and lower body, other than those muscles in the lower back, from participating in the rotational movement during the test, rehabilitation or exercise procedure. These extraneous muscle groups, such as muscles in the pelvic area, legs, shoulders, and arms, must be adequately stabilized if the rotational strength of the musculature in the lower back is to be effectively measured in isolation during the test, rehabilitation or exercise procedure. Also, the patient's lower back musculature range of rotational motion cannot be determined unless these extraneous muscle groups are prevented from taking part in the rotational movement.

Securing the upper and lower body of the patient by use of belts alone is not sufficient, because belts are not rigid enough to provide the degree of stabilization required. Further, the stabilization provided by belts alone is not reproducible, i.e., it cannot be guaranteed that the patient will be stabilized in the same way for each individual test, rehabilitation or exercise procedure. Further, stabilization by belts alone often causes discomfort or pain to the patient. Any major discomfort or pain to the patient during the test, rehabilitation or exercise procedure inhibits the patient in his or her rotational movement, producing inconsistent measurements of the strength of the musculature in the lower back and of the rotational range of motion.

SUMMARY OF THE INVENTION

The present invention is for a lower body stabilization apparatus for a back test, rehabilitation and exercise machine designed for the isolated testing, rehabilitation and exercise of the lower back musculature of a person in rotation about a vertical axis. The lower body stabilization apparatus of the present invention has a seat column which is movably attached to a frame of the machine. The seat column may only move vertically in relation to the frame of the machine. Rigidly attached to the seat column is a seat upon which the person sits during the test, rehabilitation or exercise procedure. Also attached to the seat column is a seat back which bears against the lower back of the person. The seat back may be slid back and forth relative to the seat so that the natural anatomical axis of the lower body of the person can be aligned with a vertical axis of rotation of a rotation assembly of the machine.

The feet of the person rest on footplates which are attached to footrails which in turn are attached to the seat column. Footbindings on the footrails prevent leg lifting and leg rotation. The footplates can be moved on the footrails in order to change the distance between the seat and the footplates so that the feet of the person rest comfortably on the footplates when the person is seated on the seat.

The person is secured to the seat and against the seat back by a lap belt and a lap belt buckle. Both the lap belt and the lap belt buckle are attached to the seat column. The lap belt is drawn across the lap of the person and secured tightly in the lap belt buckle. This prevents forward or backward movement of the pelvis and also prevents upward or downward movement of the pelvis.

Side cushions rotatably attached to the seat back, one on each side of the seat back, bear against the pelvis and prevent lateral movement of the pelvis. Each side cushion is attached to a pivot arm and is rotated into proper position against the pelvis and held in place by a self-locking ratchet mechanism. There is one self-locking ratchet mechanism in each of the two pivot arms. When the side cushions have been rotated to the proper position against the pelvis, the self-locking ratchet mechanism locks each pivoting arm of the side cushions in place with the side cushions bearing against the person's pelvis.

A knee pad assembly, which prevents rotation of the pelvis and rotation of the thighs, is secured in a receiving tube in the seat column. The knee pad assembly has knee pads which press against the inside of the person's legs between the knees and thighs. The knee pad assembly also has leg straps looped around the outside of the thighs. The leg straps are secured in leg strap buckles.

DETAILED DESCRIPTION OF THE INVENTION

Figure 1:
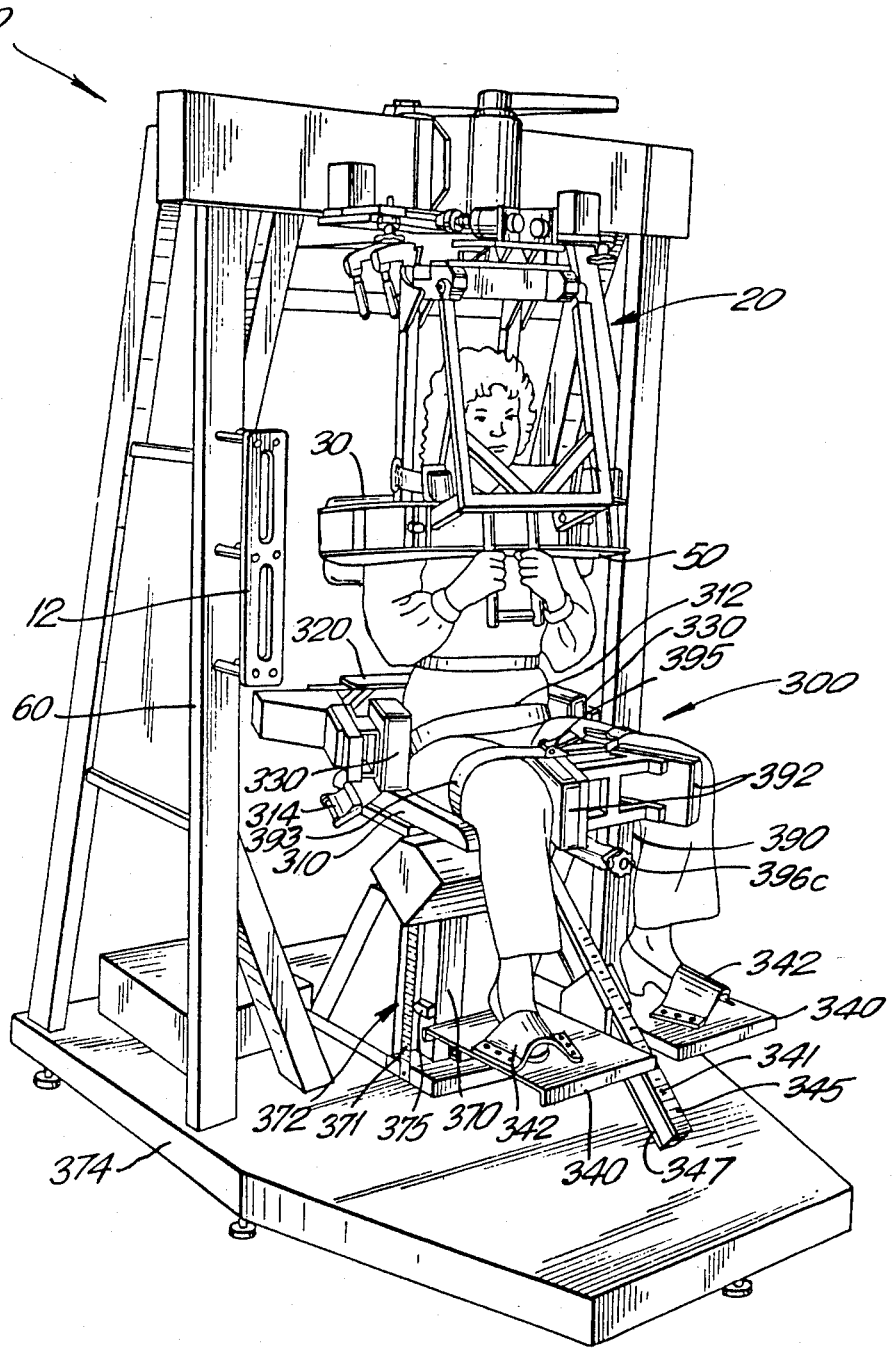
FIG. 1 is a perspective view of a back test, rehabilitation and exercise machine with a person secured in a lower body stabilization apparatus of the present invention.
Figure 2:
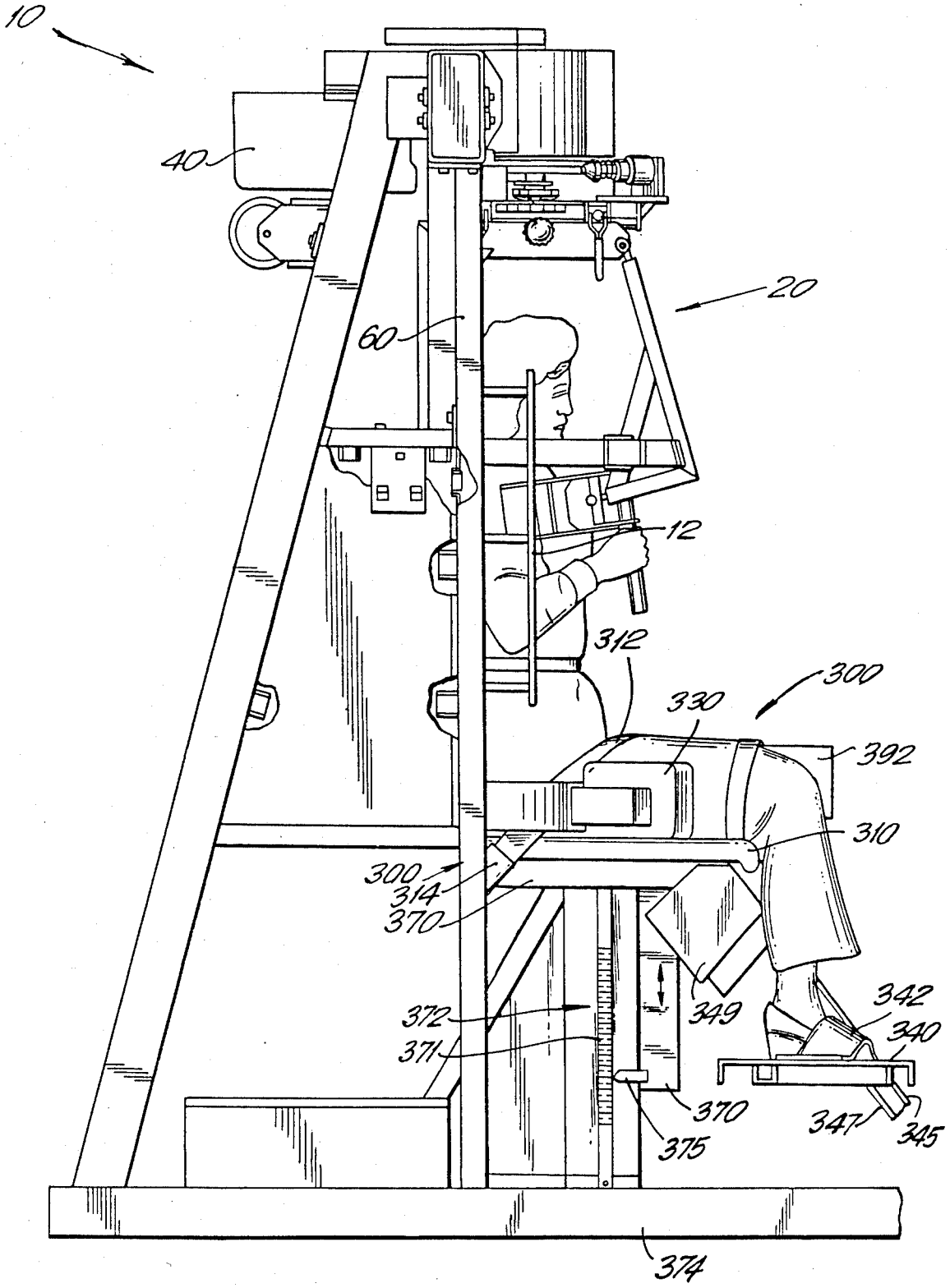
FIG. 2 is a side elevational view of the machine of FIG. 1.

A back test, rehabilitation and exercise machine 10 which contains a lower body stabilization apparatus 300 of the present invention is shown in FIGS. 1 and 2. The details of the lower body stabilization apparatus 300 are shown in FIGS. 3, 4, 4A, 5, 5A, 6, 6A, and 7.

The machine 10 is designed to measure the rotational strength of the lower back musculature of a patient without involvement in the rotation of muscle groups other than those muscles in the lower back. The measurement made by the machine 10 allows quantification of rotational strength and deficits throughout a patient's range of motion as the patient rotates his or her lower back musculature.

An isokinetic dynamometer 40, which is connected to a rotation assembly 20 of the machine 10, measures the patient's strength as he or she tries to rotate against a chest pad 50 and a scapula pad 30 of the rotation assembly 20, which are bearing against the chest and scapula of the patient, respectively, as shown in FIG. 1. During the test, rehabilitation or exercise procedure, the upper body of the patient is secured to the rotation assembly 20. The rotation assembly 20 is the subject of applicant's copending application entitled "Upper Body Rotation Assembly For A Back Test, Rehabilitation and Exercise Machine," filed concurrently with this application. The description of the rotation assembly 20 contained in that application is incorporated herein by reference.

The isokinetic dynamometer 40, which provides resistance to the patient's rotation of the rotation assembly 20, is connected to the rotation assembly 20 by a mechanical connection (not shown). The dynamometer 40 operates on the well-known theory of isokinetics whereby the speed of rotation of the rotation assembly 20 cannot exceed a pre-determined limit. The pre-determined speed of rotation of the rotation assembly 20 is set by making a selection from dynamometer controls (not shown) on the dynamometer 40.

The general theory of isokinetics is described in U.S. Pat. No. 3,465,592 issued to J. J. Perrine on Sept. 9, 1969. The description of isokinetics contained in that patent is incorporated herein by reference.

Until such time as the patient exerts a force on the chest pad 50 and the scapula pad 30 sufficient to make the rotation assembly 20 rotate at the pre-determined speed, the patient will not feel any resistive force. However, any attempt by the patient to accelerate the rotation assembly 20 beyond the pre-determined speed results in the dynamometer 40 providing an accommodating, resistive force equal to the rotation force exerted by the patient. Therefore, the patient cannot make the rotation assembly 20 rotate any faster than the pre-determined speed, and any increased force exerted by the patient is met by an equal accommodating, resistive force from the dynamometer 40.

The isokinetic dynamometer 40 in the present embodiment is similar to the dynamometer which is available as part of the Cybex ® II+ test, rehabilitation and exercise machine, which is manufactured and sold by the Cybex Division of Lumex Inc., 2100 Smithtown Ave., Ronkonkoma, N.Y.

Since the dynamometer 40 provides an accommodating, resistive force equal to the rotation force exerted by the patient, measurement of the force provided by dynamometer 40 is also a measurement of the rotational strength of the lower back musculature of the patient throughout the patient's range of rotational motion. A computer (not shown) can be used to record this measurement and process a group of measurements for further analysis of the patient's progress during the test, rehabilitation or exercise procedure.

The sequence for securing the patient in the machine 10 is described below in order to more fully illustrate and describe the structure of the lower body stabilization apparatus 300 of the present invention.

The patient is first seated in the machine 10 on the seat 310. The feet of the patient rest on two footplates 340. The feet of the patient are secured to the footplates 340 by foot bindings 342 which are attached to footplates 340 as shown in FIG. 1. By placing his or her feet into the foot bindings 342, the patient secures the feet so as to prevent leg lifting or leg rotation during the test, rehabilitation or exercise procedure.

Figure 7:
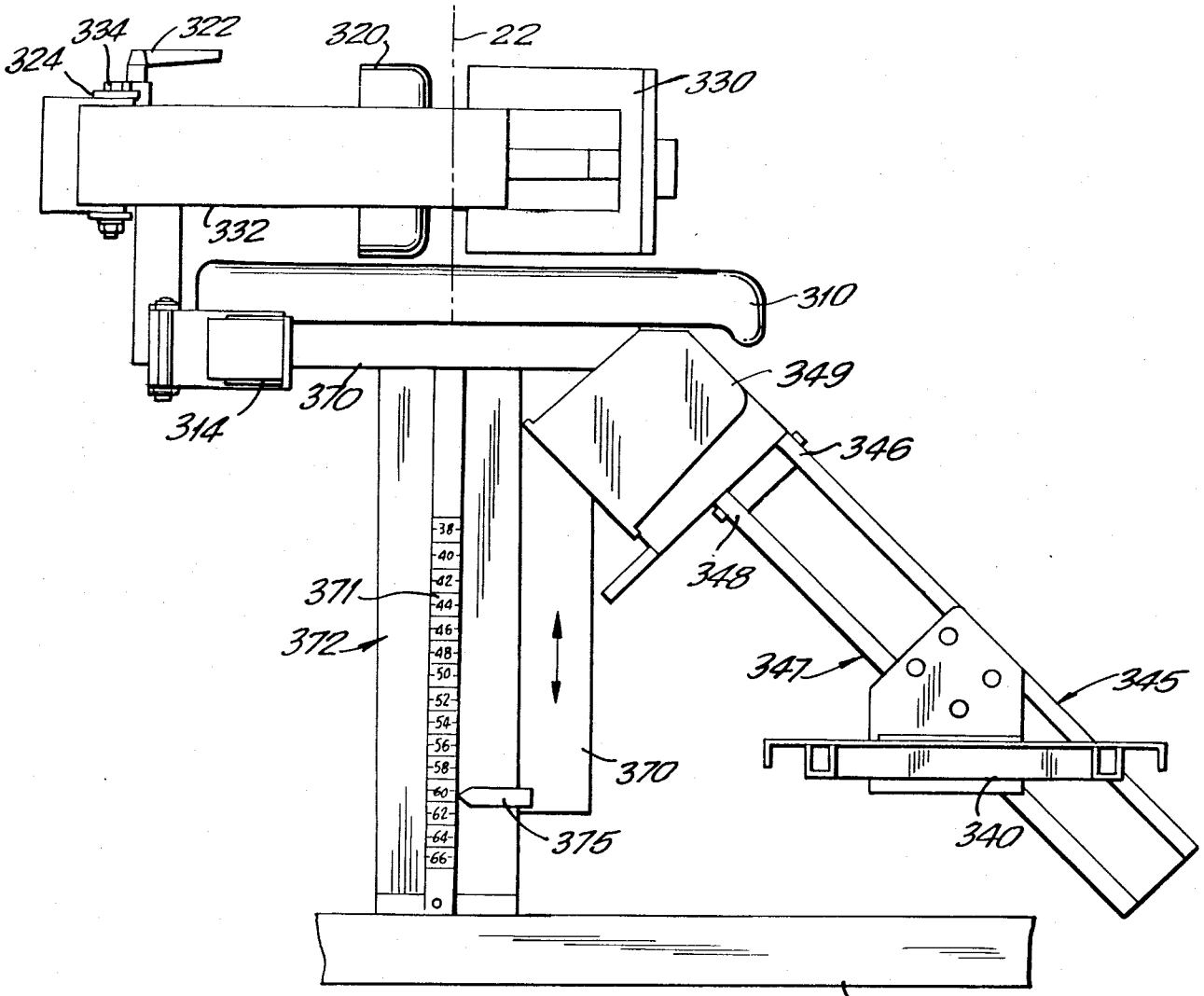
FIG. 7 is a partial side elevational view of the lower body stabilization apparatus of the present invention without the knee pad assembly.

Both footplates 340 are attached to a top footplate rail 345 and a bottom footplate rail 347. The attachment of the right footplate 340 to the footplate rails 345 and 347 is shown in FIG. 7. The left footplate 340 is similarly attached to the footplate rails 345 and 347. The footplate rails 345 and 347, at their upper ends 346 and 348, are attached to a footplate drive mechanism 349 which is rigidly attached to a seat column 370. The seat 310 is also rigidly attached to the seat column 370.

The operator adjusts the height of the footplates 340 so that, with the patient seated on the seat 310, the patient's feet rest comfortably on the footplates 340. The operator adjusts the height of the footplates 340 in relation to the seat 310 by use of a footplate motor (not shown). In the present embodiment, the footplate motor is operably connected to the upper ends 346 and 348 of the footplate rails 345 and 347 and is located in the footplate drive mechanism 349. Under the control of the footplate motor the footplates 340 move on footplate rails 345 and 347 at a 45° angle relative to the seat 310. The operator can note the position of footplates 340 by reference to a footplate position scale 341 which is on the top footplate rail 345 as shown in FIG. 1. The operator can use the position information from the footplate position scale 341 at a later time when the patient returns for further testing, rehabilitation or exercise on the machine 10 to reproduce from a previous testing, rehabilitation, or exercise procedure the exact positional relationship between the footplates 340 and the seat 310.

After the position of the footplates 340 relative to the seat 310 is adjusted by the operator, the operator then adjusts the height of the seat 310 so that a scapula pad 30 of the rotation assembly 20 rests against the scapula of the patient.

The seat column 370, to which the seat 310 is rigidly attached, is movably attached to a seat column lift assembly 372. The seat column 370 is attached to the seat column lift assembly 372 in such a manner that the seat column 370 may only move in a vertical direction with respect to the seat column lift assembly 372 as shown by the arrows in FIGS. 2 and 7. The seat column lift assembly 372 is rigidly attached to a frame base 374 of frame 60 of the machine 10.

Using the seat column lift assembly 372, which includes a seat lift motor (not shown), the operator can adjust the height of the seat 310 to the desired position. Since the seat 310 is rigidly attached to the seat column 370, vertical movement of the seat column 370 causes corresponding vertical movement of the seat 310.

Figure 6:
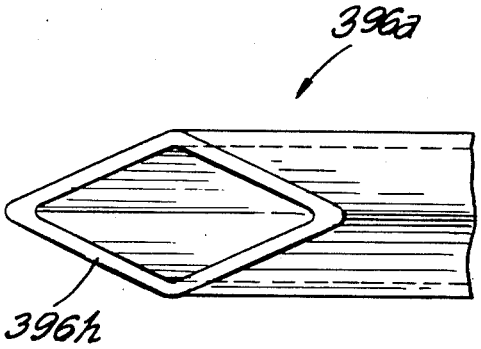
FIG. 6 is a bottom view in isolation of a front diagonal tube of the knee pad assembly of FIGS. 4 and 5 showing how a first end of the front diagonal tube is cut at a compound angle.

The operator can note the position of the seat column 370 with reference to the seat column lift assembly 372 by referring to a seat position label 371 which is attached to the seat column lift assembly 372 as shown in FIG. 6. A pointer 375 on the seat column 370 is used to easily determine the height of the seat column 370 with reference to the seat position label 371 on the seat column lift assembly 372.

Since the seat 310 and the footplate rails 345 and 347 (through the footplate drive mechanism 349) are all attached to the seat column 370, vertical movement of the seat 310 as described above results in a corresponding vertical movement of the footplates 340. This insures that the patient will remain comfortably seated with his or her feet on the footplates 340, without changing the positional relationship of the footplates 340 to the seat 310 as the seat 310 is raised or lowered to the desired position. The relative position of the seat 310 to the footplates 340 will remain constant as the seat 310 is moved to the desired height.

After the patient is seated on the seat 310 at the desired height, it is necessary to align the patient's natural anatomical axis with a vertical axis of rotation 22 of the rotation assembly 20. The vertical axis of rotation 22 of the rotation assembly 20 is represented by the dotted line 22 shown in FIG. 7.

The alignment of the upper part of the patient's natural anatomical axis, i.e., that part above the waist of the patient, is described in applicant's copending application entitled "Upper Body Rotation Assembly For A Back Test, Rehabilitation and Exercise Machine." That description is incorporated herein by reference.

The alignment of the lower part of the patient's natural anatomical axis, i.e., that part below the waist of the patient, is accomplished by sliding a seat back 320 backward or forward as required. The seat back 320 bears against the lower back of the patient. Rigidly attached to the seat back 320 is a seat back tube 321 which slides in a receiving tube 323. The receiving tube 323 is rigidly attached to the seat column 370. The seat back tube 321 may slide forward or backward in the receiving tube 323 when a handle 322 on the receiving tube 323 is placed in the released position by the operator. Since the seat back 320 is rigidly attached to the seat back tube 321, sliding the seat back tube 321 back and forth in the receiving tube 323 also causes the seat back 320 to slide back and forth.

In the present embodiment, the operator of the machine 10 accomplishes the alignment of the lower part of the patient's anatomical axis with the axis of rotation 22 of the rotation assembly 20 by visual means. With the patient seated on the seat 310, and the seat back 320 resting against the lower back of the patient, and the handle 322 in the released position, the operator stands to one side of the machine 10 and slides the seat back 320 backward or forward until a bracket 12 on the frame 60 of the machine 10 is in visual alignment with the sagittal midline plane of the lower part of the patient. Bracket 12, which is best seen in FIG. 2, is mounted on the frame 60 in alignment with the vertical axis of rotation 22 of the rotation assembly 20.

Once the operator completes the alignment of the lower part of the patient's natural anatomical axis, he places the handle 322 in the locked position. This locks the seat back 320 at the desired position.

Figure 3:
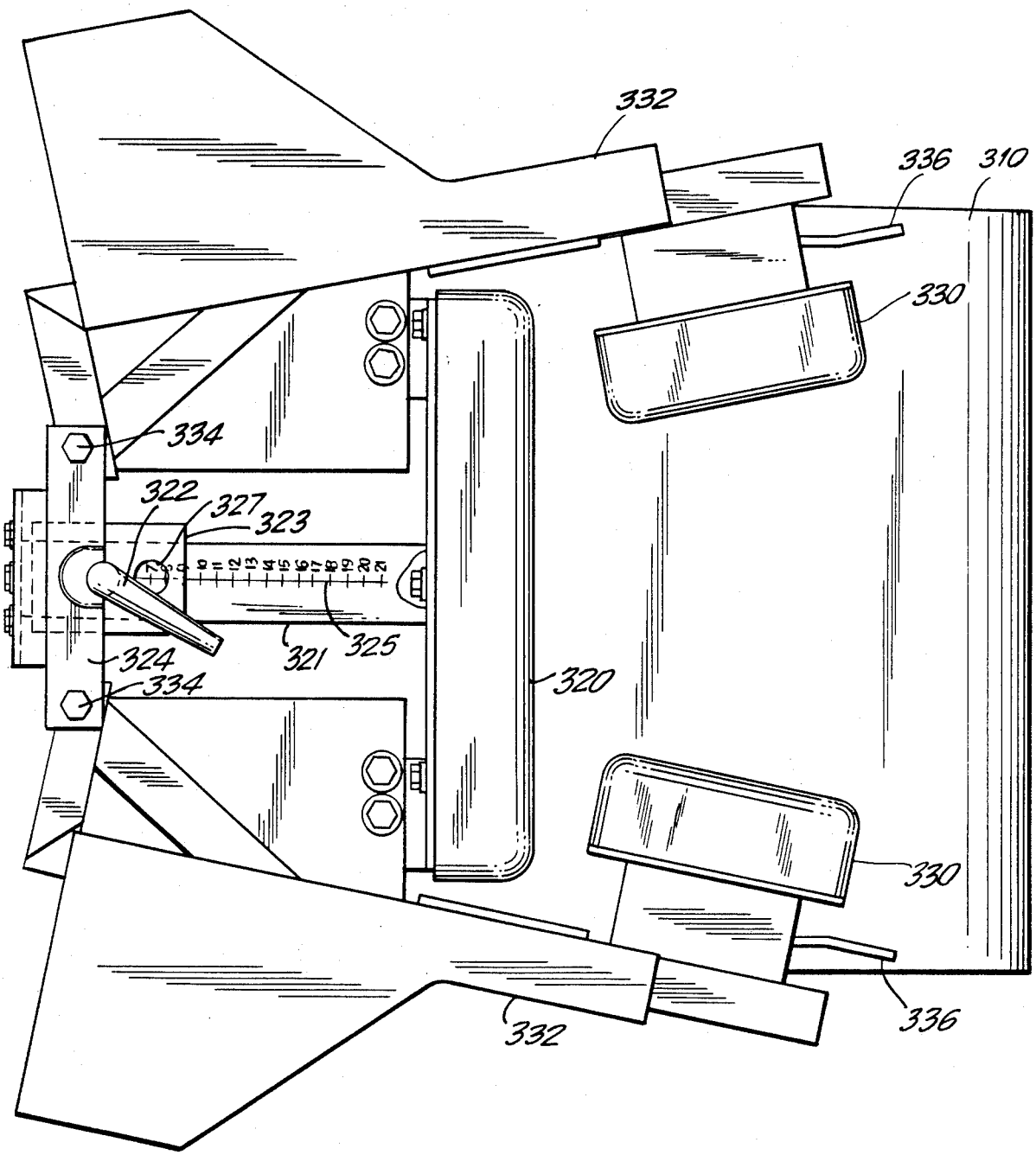
FIG. 3 is a partial top view of the lower body stabilization apparatus of the present invention.

The tube 321 has a seat back position scale 325 as shown in FIG. 3. The position of seat back 320 relative to the seat 310 is determined by reading the seat back scale 325 through a window 327 in the receiving tube 323. This allows the operator to reproduce the exact alignment of the lower part of the patient's natural anatomical axis the next time the patient returns for a further test, rehabilitation or exercise procedure on the machine 10.

After the natural anatomical axis of the patient is aligned with the axis of rotation 22 of rotation assembly 20, the pelvis and thighs of the patient are secured to the machine 10 in the following manner.

First, a lap belt 312 is drawn across the lap of the patient and secured into lap belt buckle 314. Lap belt 312 and lap belt buckle 314 are each attached to the seat column 370, with the lap belt 312 attached to one side of the seat column 370 and the lap belt buckle 314 secured to the other side of the seat column 370. The attachment of the lap belt buckle 314 to the seat column 370 is shown in FIG. 7. The lap belt 312 is attached to the opposite side of the seat column 370 in the same manner.

Once the lap belt 312 is secured in the lap belt buckle 314, the lap belt 312 is tightened to pull the patient back firmly against the seat back 320 and also to press the patient down against the seat 310. The stabilization accomplished by the lap belt 312 prevents any forward or backward movement by the patient of his or her pelvis and also prevents any upward or downward movement of the pelvis.

Next, side cushions 330 are secured against the patient's pelvis in order to prevent lateral movement of the pelvis. Each side cushion 330 is mounted on a pivoting arm 332. Each pivoting arm 332 is pivotally attached to a pivot support 324 at connection points 334 as shown in FIG. 3. The pivot support 324 is rigidly attached to the seat back tube 321.

In order to adjust the side cushions 330 to the proper position, the operator simply pushes the pivoting arm 332, rotating the pivoting arm 332 into position with pad 330 securely against the patient. A ratchet mechanism (not shown) in the pivoting arm 332 will allow rotation of the pivoting arm 332 toward the patient and will not allow rotation away from the patient unless release lever 336 is pressed. Once the pivoting arm 332 is rotated into place, the ratchet mechanism will automatically hold the pivoting arm 332 and the side cushion 330 in place. The operator then repeats this procedure for the other side cushion 330.

Because the position of each side cushion 330 is adjustable, prevention of lateral pelvic movement is easily obtained for patients of different pelvic widths.

A knee pad assembly 390, which is shown in FIGS. 1, 4, 4A, 5, 5A, 6 and 6A, is used to prevent pelvic rotation and thigh movement of the patient. The knee pad assembly 390 in the present embodiment has two knee pads 392 which bear against the inside of the patient's legs between the knees and thighs of the patient as shown in FIG. 1. The knee pads 392 are attached to one another and to a tube assembly 396 by a knee pad support structure 394 which in the present embodiment consists of metal tubes welded together.

The tube assembly 396 is shown in FIGS. 4, 5, 6 and 6A. In the present embodiment, the tube assembly 396 comprises a front diagonal tube 396*a*, a rear diagonal tube 396*b*, a lock knob 396*c*, a rod 396*d*, a spring 396*e* and an anti-friction plate 396*f*. The front diagonal tube 396*a* and the rear diagonal tube 396*b* are square in the present embodiment.

Figure 4:
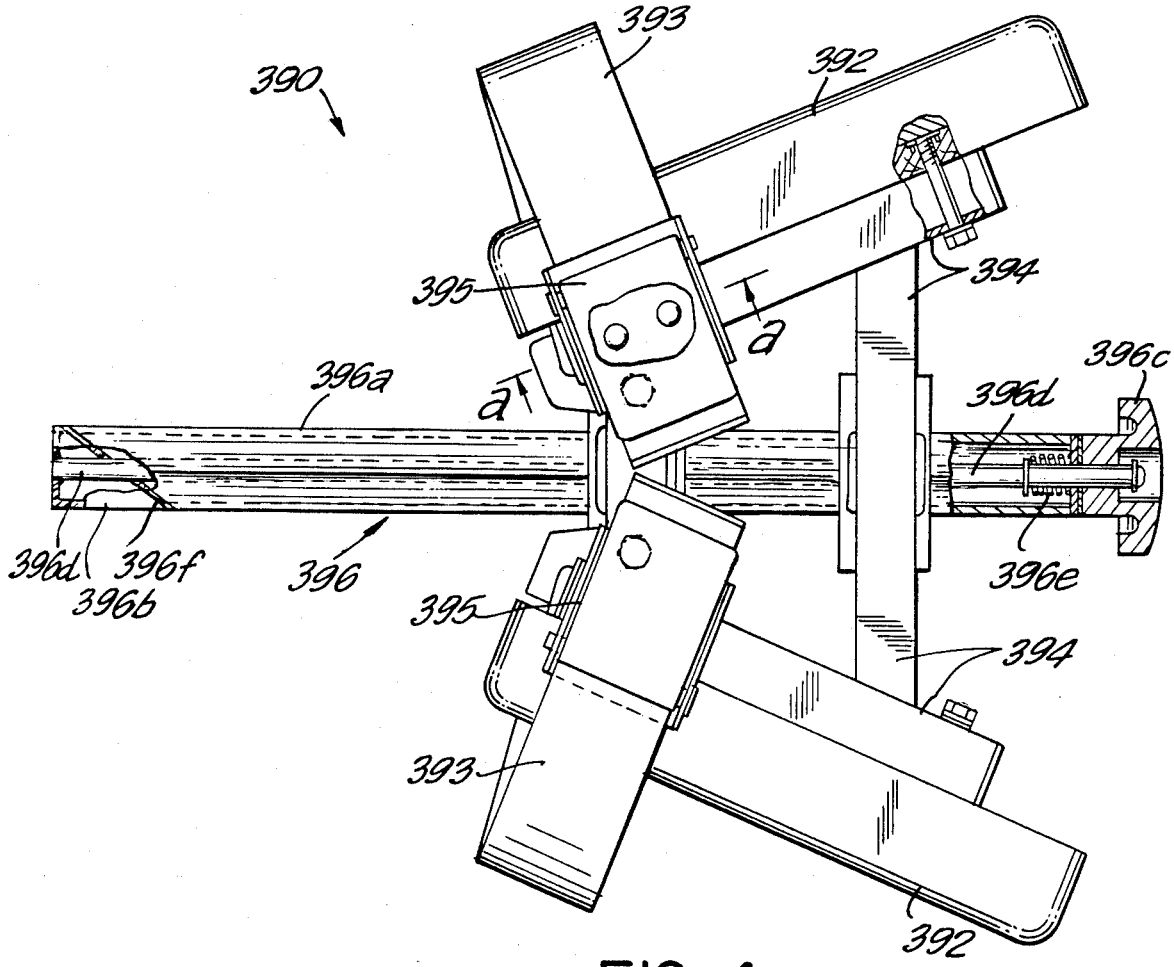
FIG. 4 is a top view, partially in section, of a knee pad assembly of the lower body stabilization apparatus of the present invention.
Figure 6A:
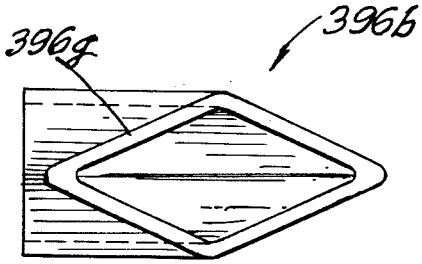
FIG. 6A is a bottom view in isolation of a rear diagonal tube of the knee pad assembly of FIGS. 4 and 5 showing how a first end of the rear diagonal tube is cut at a compound angle.

The front diagonal tube 396*a* has a first end cut at a compound angle as shown in FIG. 6. The rear diagonal tube 396*b* also has a first end cut at the same compound angle, as shown in FIG. 6A. The first end of the rear diagonal tube 396*b* has a compound angle surface 396*g* and the first end of the front diagonal tube 396*a* has a compound angle surface 396*h*, as shown in FIGS. 6A and 6. A first end of the rod 396*d* is rigidly attached inside a second end of the rear diagonal tube 396*b* and extends through the inside of the front diagonal tube 396*a*. A second end of the rod 396*d* is attached to a lock knob 396*c*, as shown in FIG. 4. The lock knob 396*c* bears against the second end of the front diagonal tube 396*a*.

The knee pad assembly 390 is placed in position as follows. After the patient has been secured to the seat 310 and the side cushions 330 rotated into place, the operator inserts the tube assembly 396 into a receiving tube (not shown) in the seat column 370. The receiving tube in the seat column 370 is of a slightly larger size than the rear diagonal tube 396*b* and the front diagonal tube 396*a* so that the tube assembly 396 may slide into the receiving tube in the seat column 370. In the present embodiment, the receiving tube in the seat column 370 is also square. The operator slides the tube assembly 396 into the receiving tube in the seat column 370 until the knee pads 392 are at the desired location with respect to the knees and thighs of the patient.

To lock the knee pad assembly 390, the operator turns the lock knob 396*c* fully clockwise, causing the rear diagonal tube 396*b* and the front diagonal tube 396*a* to be drawn together as a result of the rod 396*d* being drawn further into the front diagonal tube 396*a*. When the surfaces 396*g* and 396*h*, of the rear diagonal tube 396*b* and the front diagonal tube 396*a*, respectively, come into contact, surface 396*g* will ride up on surface 396*h*, causing expansion inside the receiving tube in the seat column 370, resulting in the tube assembly 396 being tightly secured in the receiving tube in the seat column 370. The configuration of the surfaces 396*g* and 396*h* shown in FIGS. 6 and 6A, results in expansion in both vertical and horizontal directions inside the receiving tube in the seat column 370 when the surfaces 396*g* and 396*h* are pushed against one another. Once secured, the knee pad assembly 390 will not move in any direction, nor will the knee pad assembly 390 rotate when secured. Securing the knee assembly 390 against any kind of movement is important in order to prevent pelvic rotation and thigh movement by the patient during the test, rehabilitation or exercise procedure.

To remove the knee pad assembly 390, the operator turns the lock knob 396*c* counterclockwise, causing the rear diagonal tube 396*b* and the front diagonal tube 396*a* to draw apart. A spring force from a spring 396*e* aids in separating the rear diagonal tube 396*b* from the front diagonal tube 396*a* when the lock knob 396*c* is turned counterclockwise. The knee pad assembly 390 may then be removed by the operator from the receiving tube in the seat column 370.

Figure 5:
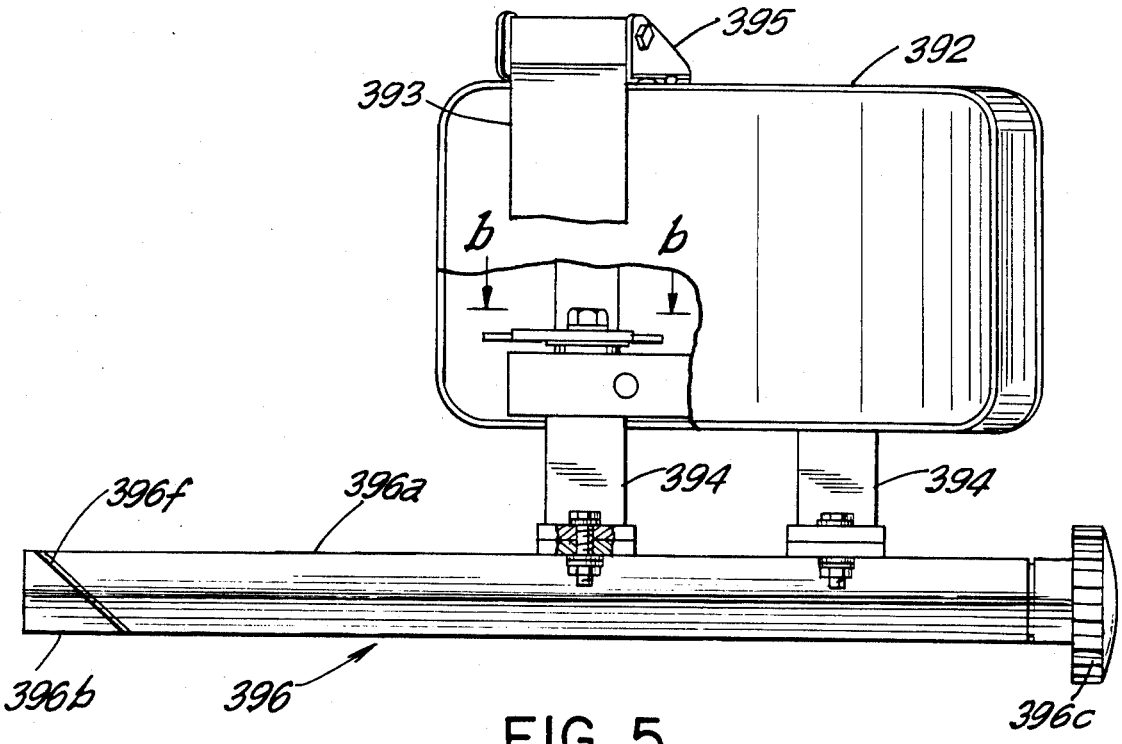
FIG. 5 is a side elevational view, partially in section, of the knee pad assembly of FIG. 4.

The anti-friction plate 396*f*, which is located between the rear diagonal tube 396*b* and the front diagonal tube 396*a*, as shown in FIGS. 4 and 5, prevents friction forces between the surfaces 396*g* and 396*h* from holding the surfaces 396*g* and 396*h* to one another when in contact, preventing sticking due to friction when surfaces 396*g* and 396*h* are wedged together, thus making it easier to move the rear diagonal tube 396*b* away from the front diagonal tube 396*a* during the removal of the knee pad assembly 390.

Figure 4A:
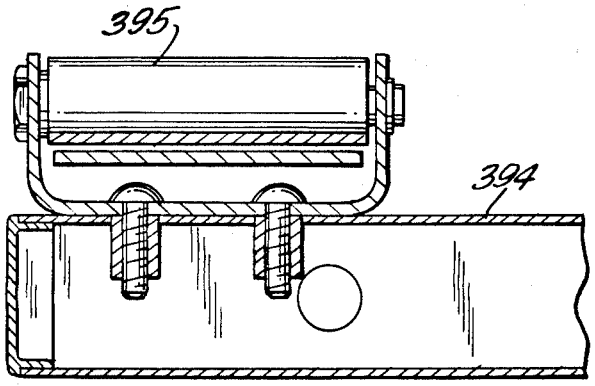
FIG. 4A is a partial view along lines a—a of FIG. 4.
Figure 5A:
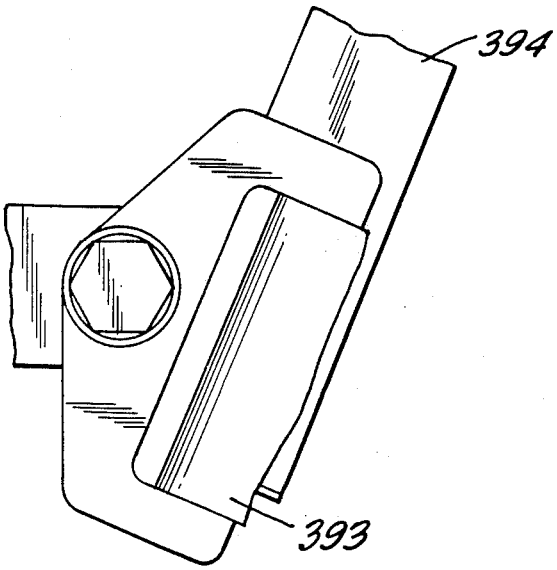
FIG. 5A is a partial view along lines b—b of FIG. 5.

To secure the outer and top portion of the patient's thighs the operator secures leg straps 393 to leg strap buckles 395. There is one leg strap 393 and one leg strap buckle 395 for each knee pad 392. The leg strap 393 is attached to the knee pad support structure 394 as shown in FIGS. 5 and 5A. The leg strap buckle 395 is also attached to the knee pad support structure 394, as shown in FIGS. 4 and 4A. To secure the leg strap 393 to the leg strap buckle 395, the operator loops the leg strap 393 around the outside of the patient's thigh as shown in FIG. 1 and secures the leg strap 393 to the leg strap buckle 395 on the top of the knee pad assembly 390 above the thigh. The operator repeats this procedure with the other leg strap 393 and leg strap buckle 395 for the other leg.

Once secured to the patient, the knee pad assembly 390 prevents pelvic rotation and thigh movement by the patient during the test, rehabilitation or exercise procedure.

It is readily seen that the use of the seat back 320, side cushions 330 and knee pads 392 insures that the lower body stabilization on machine 10 for one test, rehabilitation or exercise procedure can be duplicated for a later test, rehabilitation or exercise procedure on machine 10.

It is to be understood that the lower body stabilization apparatus 300 of the present invention could be used on a machine for testing of the lower back rotational strength of persons other than in a medical or rehabilitation setting. For example, the back test, rehabilitation and exercise machine may used for industrial screening of potential employees in order to analyze if such persons have the lower back rotational strength and range of motion necessary for certain job functions.

Also, the lower body stabilization apparatus of the present invention could be used on an exercise machine designed for the exercise of a person's lower back in rotation about a vertical axis without involvement in the exercise of muscles other than in the lower back.

Applicant's invention is not limited to the embodiment of the lower body stabilization apparatus described above, but it is understood that applicant's invention is as set forth in the following claims.

I claim:

1. A lower body stabilization apparatus for a back test, rehabilitation and exercise machine designed for the isolated testing, rehabilitation and exercise of the lower back musculature of a person in rotation about a vertical axis comprising:

a seat column attached to a frame of the machine;

a seat attached to the seat column;

a seat back attached to the seat column;

means attached to the seat column for securing the person to the seat and up against the seat back to prevent forward or backward movement of the pelvis and also to prevent upward or downward movement of the pelvis;

two side cushions rotatably attached to the seat column wherein the side cushions move in an arcuate path when rotated, said side cushions for bearing against the pelvis and preventing lateral movement of the pelvis;

an adjustable knee pad assembly attached to the seat column for preventing rotation and lateral movement of the pelvis and rotation of the thighs wherein the knee assembly comprises two knee pads, each secured against the inside of one of the legs between the knees and thighs and means for securing the outside and top of the thighs against movement, wherein the center of application of the force of the side cushions against the pelvis is in the same horizontal plane as the center of application of the force of the knee pads against the inside of the knees; and means attached to the seat column for preventing rotation of the legs and lifting of the legs.

2. The lower body stabilization apparatus of claim 1 also comprising means for moving the seat column in a vertical direction relative to the frame.

3. The lower body stabilization apparatus of claim 2 wherein the moving means comprises a seat column lift assembly attached to the frame for moving the seat column wherein the seat column lift assembly includes a seat position label for determining the position of the seat column with respect to the seat column lift assembly.

4. The lower body stabilization apparatus of claim 1 wherein the seat back may slide backward or forward relative to the seat so that a natural anatomical axis below the waist of the person may be aligned with a vertical axis of rotation of a rotation assembly of the machine.

5. The lower body stabilization apparatus of claim 1 wherein the means for securing the person to the seat and up against the seat back comprises a lap belt secured in a lap belt buckle.

6. The lower body stabilization apparatus of claim 1 wherein the means for preventing rotation of the legs and lifting of the legs comprises foot bindings attached to footplates wherein the footplates are attached to the seat column and are adjustable along a 45° path relative to the seat.

7. The lower body stabilization apparatus of claim 1 wherein the means for securing the thighs against movement comprises leg straps secured at the top of the knee pad assembly above the thigh.

8. A lower body stabilization apparatus for a back test, rehabilitation and exercise machine designed for the isolated testing, rehabilitation and exercise of the lower back musculature of a person in rotation about a vertical axis comprising:

a seat column movably attached to a frame of the machine wherein the seat column may move only in a vertical direction relative to the frame of the machine;

a seat rigidly attached to the seat column;

a seat back movably attached to the seat column wherein the seat back may be moved backward or forward relative to the seat;

a lap belt and lap belt buckle attached to the seat column for securing the person to the seat and up against the seat back to prevent forward or backward movement of the pelvis and also to prevent upward or downward movement of the pelvis;

two side cushions rotatably attached to the seat column wherein the side cushions move in an arcuate path when rotated, said side cushions for bearing against the pelvis and preventing lateral movement of the pelvis;

means for attaching two footplates to the seat column wherein the feet of the person rest in foot bindings which are attached to the footplates wherein the foot bindings prevent rotation of the legs and lifting of the legs; and an adjustable knee pad asembly secured in a receiving tube of the seat column for preventing rotation and lateral movement of the pelvis and movement of the thighs, wherein said knee pad assembly may be easily inserted and removed from said receiving tube, said knee pad assembly comprising a rear diagonal tube attached to a knee pad support structure wherein the rear diagonal tube at a first end is cut at a compound angle;

a front diagonal tube attached to the knee pad support structure wherein the front diagonal tube at a first end is cut at the same compound angle as the rear diagonal tube;

means connecting the rear diagonal tube to the front diagonal tube;

two knee pads attached to the knee pad support structure each for placement against the inside of one of the legs between the knees and thighs;

means attached to the knee pad support structure for securing the outside and top of the thighs against movement;

receiving means in the machine for receiving inside thereto the rear diagonal tube and the front diagonal tube; and means for drawing the first end of the rear diagonal tube against the first end of the front diagonal tube inside the receiving means wherein the first end of the rear diagonal tube and the first end of the front diagonal tube slide relative to one another inside the receiving means for preventing movement in vertical and horizontal directions and for preventing rotational movement of the knee pad assembly, wherein the center of application of the force of the side cushions against the pelvis is in the same horizontal plane as the center of application of the force of the knee pads against the inside of the knees.

9. The lower body stabilization apparatus of claim 8 wherein the means for attaching the footplates to the seat column comprise two footrails positioned at a 45° angle relative to the seat.

10. The lower body stabilization apparatus of claim 8 also comprising means for moving the footplates on the footrails at a 45° angle relative to the seat.

11. The lower body stabilization apparatus of claim 8 also comprising a footplate position scale for determining the position of the footplates relative to the seat.

12. The lower body stabilization apparatus of claim 8 also comprising means for aligning a natural anatomical axis below the waist of the person with the axis of rotation of a rotation assembly of the machine.

13. The lower body stabilization apparatus of claim 8 also comprising a seat back position scale for determining the position of the seat back relative to the seat.

14. The lower body stabilization apparatus of claim 8 wherein self-locking ratchet mechanisms in pivoting arms of the side cushions lock the side cushions against the pelvis.

15. The knee pad assembly of claim 8 wherein the means for connecting the rear diagonal tube to the front diagonal tube comprises a rod rigidly attached at a first end to a second end of the extending rear diagonal tube and extending through the front diagonal tube to a second end of the front diagonal tube wherein a second end of the rod is rigidly attached to the drawing means.

16. The knee pad assembly of claim 15 wherein the means for drawing comprises a locking knob attached to the second end of the rod and bearing against the second end of the front diagonal tube.

17. The knee pad assembly of claim 8 wherein the means attached to the knee pad support assembly for securing the outside and top of the thighs against movement comprises leg straps looped around the outside of the thighs and secured in leg strap buckles on the above the thighs wherein the leg straps and leg strap buckles are attached to the knee pad support structure.

18. The knee pad assembly of claim 8 also comprising an anti-friction plate positioned between the rear diagonal tube and the front diagonal tube for preventing the rear diagonal tube and the front diagonal tube from sticking together when locked inside the receiving means.

* * * * *